United States Patent [19]

Teli et al.

[11] 4,312,158

[45] Jan. 26, 1982

[54] FIRE-RESISTANT DEMOUNTABLE PARTITION STRUCTURE

[75] Inventors: Jonathan P. Teli, Avon Lake; Robert F. Worley, Bay Village, both of Ohio

[73] Assignee: Donn Incorporated, Westlake, Ohio

[21] Appl. No.: 76,870

[22] Filed: Sep. 19, 1979

[51] Int. Cl.[3] ..... E04F 19/00

[52] U.S. Cl. ..... 52/39; 52/241; 52/281; 52/368; 52/346

[58] Field of Search ..... 52/39, 241, 242, 243, 52/281, 368, 481, 483, 346, 347, 232

[56] References Cited

U.S. PATENT DOCUMENTS

| | | | |
|---|---|---|---|
| 1,739,754 | 12/1929 | Foster | 52/368 |
| 1,798,197 | 3/1931 | Eichner | 52/481 |
| 1,959,135 | 5/1934 | Miller | 52/241 |
| 1,981,240 | 11/1934 | McNeil | 52/359 |
| 2,010,412 | 8/1935 | Parsons | 52/481 |
| 3,495,417 | 2/1970 | Ratliff | 52/241 |
| 3,638,387 | 2/1972 | Lickliter | 52/241 |
| 3,859,765 | 1/1975 | Nelsson | 52/241 |
| 3,900,996 | 8/1975 | Yohe | 52/241 |

FOREIGN PATENT DOCUMENTS

| | | | |
|---|---|---|---|
| 448513 | 9/1913 | France | 52/368 |
| 975236 | 3/1951 | France | 52/489 |

*Primary Examiner*—Price C. Faw, Jr.
*Assistant Examiner*—Henry E. Raduazo
*Attorney, Agent, or Firm*—Pearne, Gordon, Sessions, McCoy & Granger

[57] ABSTRACT

A fire rated, demountable partition structure is disclosed which provides H-shaped studs having a core of combustion-resistant insulation material and opposed channel-shaped metal members secured to opposite faces thereof. Spline clips secure one side of the stud to the panel at joints therebetween. Each clip includes a lateral projection extending with a close fit into a kerf in the edge of the panel and a reverse bend providing opposed clip walls which fit along opposite sides of an adjacent flange on the stud. If the partition is exposed to a fire or the like, which tends to cause shrinkage of the panels and opening of the joints, the core of the stud bridges the joint and prevents direct exposure of the metal channel elements of the stud to heat or water through the opened joint. The spline clips are free to expand if the clips are subjected to greater heat than the channel members so that the stud is not caused to bow toward the fire side of the partition.

17 Claims, 4 Drawing Figures

FIRE-RESISTANT DEMOUNTABLE PARTITION STRUCTURE

BACKGROUND OF THE INVENTION

This inventon relates generally to partition structures, and more particularly to a novel and improved demountable partition structure having improved fire resistance characteristics.

PRIOR ART

Partition structures which utilize metal studs that interlock with kerfs in the edge of the wallboard are known. Usually such wallboards are gypsum sheets which are often surfaced with a sheet of decorative vinyl or the like. Such partitions are usually referred to as demountable walls because the partitions are easily assembled and are relatively easily disassembled. Examples of such wall structures are described in U.S. Pat. Nos. 2,154,520; 3,027,605; 3,712,015; 3,729,883; 3,732,657; 3,908,328; and 3,998,027. Such wall structures often provide an H-shaped metal stud which has one or more projections proportioned to fit into a kerf provided along the adjacent edge of adjacent panels. Although such structures are generally desirable because of their ease of assembly and disassembly, problems can exist if they are subjected to fire.

Gypsum board panels are substantially noncombustible, but if sufficient heat is transmitted from the fire-exposed side to the unexposed sides of the partition, the partition can fail to resist the spread of the fire.

Standards have been developed to determine if the particular partition structure provides sufficient fire resistance to be termed "fire-rated." Such tests involve subjecting the partition to fire heat conditions on one side for predetermined periods of time. The ability of the partition to withstand such heat without exceeding specified temperatures on the unexposed side determines if the partition is satisfactory from the standpoint of resisting the spread of fire. Thereafter the partition is usually subjected to a hose stream test to simulate a condition which occurs when a fire is extinguished.

When gypsum board is subjected to a fire environment, the boards tend to shrink 1% or more. Such shrinkage tends to open the joint between the panels, which in turn exposes the metal frame structure. In the prior art studs, this can cause unacceptably high temperatures to be transmitted through to the unexposed side of the wall. Further, if the metal studs are excessively heated along one side, a deflection toward the fire develops, which increases the amount of framing exposed to the fire and causes a straining of the weakened gypsum board, often to the point of failure and collapse of the fire side board and rapid deterioration of the total wall assembly.

SUMMARY OF THE INVENTION

In accordance with the present invention, a demountable partition structure is provided which utilizes an H-shaped stud that is formed by securing opposed U-shaped channels to opposite sides of a core formed of a nonmetallic insulation material. In the illustrated embodiment, the core is formed of gypsum board.

A stud is connected to the wall panels along each joint between adjacent panels by metal spline clips which extend around the adjacent flanges of the stud and into the kerfs formed in the abutting edges of the panel along the joint. The stud is supported at its upper end on the ceiling track and is spaced from the floor track at its lower end.

When a wall incorporating this invention is exposed to fire, the joints tend to open up because of shrinkage of the panels themselves. The portion of the stud which is directly exposed to heat through the opened joint is a gypsum board core. Therefore, the metal portions of the stud are not heated enough to cause excessive heat transfer to the unexposed side of the partition. The only metal parts of the stud assembly that are directly exposed to heat are the spline clips. Because these clips are spline-connected to the metal channels of the stud, they can expand axially with respect to the channel-shaped members without causing a deflection of the stud. Further, since the clips do not extend across the open joint created by the shrinkage, they do not tend to be heated as much as the exposed metal of the prior art.

With the present invention, the insulation material of the core of the stud functions to bridge the joint when shrinkage occurs to provide continuing insulation of the metal of the stud and to provide a seal across the joint which resists penetration of heat or water into the partition when the partition is exposed to the excessive heats which occur during a fire and when water is used to extinguish the fire.

DETAILED DESCRIPTION OF THE DRAWINGS

Figure 1:
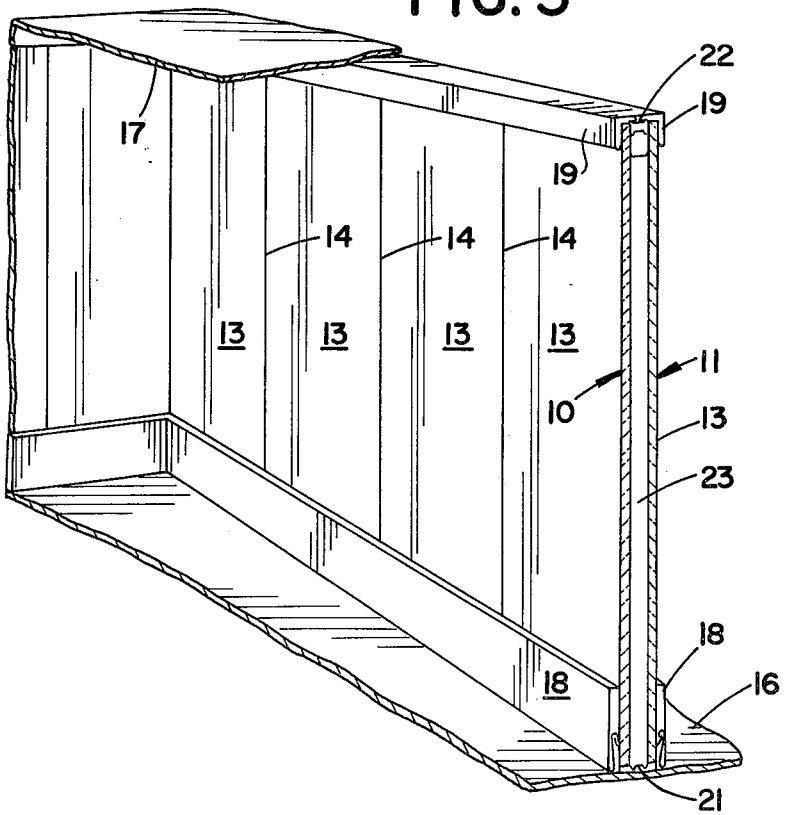
FIG. 1 is a fragmentary, perspective view of a portion of an installed partition in accordance with the present invention.

FIG. 1 is a fragmentary, perspective view of a typical installation of a removable partition in accordance with this invention. Such an installation includes spaced and parallel rows 10 and 11 of gypsum board panels 13, which abut adjacent panels along joints 14 and extend between a floor structure 16 and a ceiling structure 17. Baseboard trim members 18 extend along the lower edge of the partition and ceiling trim members 19 extend along the upper edge of the partition. The lower edge of each panel is secured to a floor track 21 and the upper edge of each panel is secured to a ceiling track 22. A plurality of studs 23 are positioned between the two rows 10 and 11 at intervals along the partition, as described below.

Figure 3:
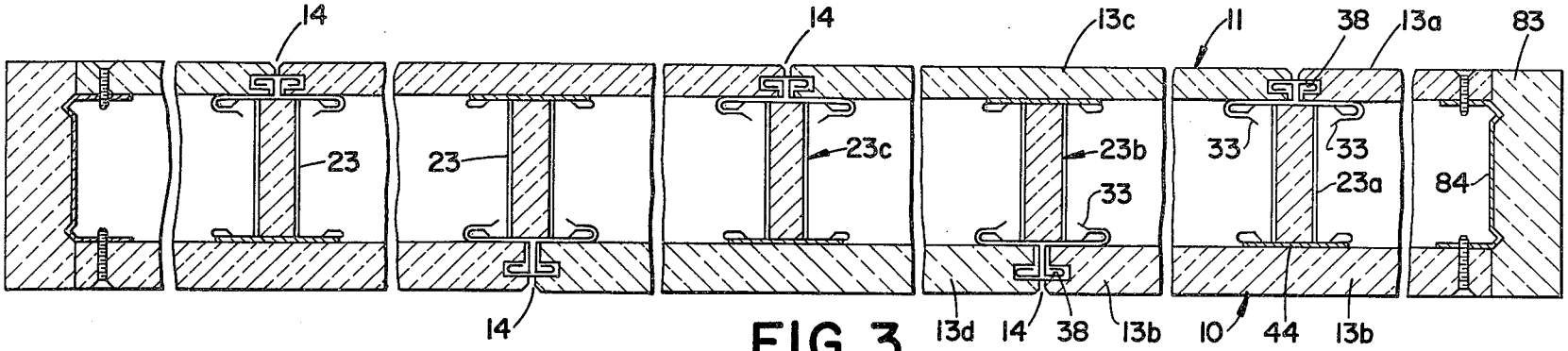
FIG. 3 is a horizontal section of one preferred partition structure in accordance with the present invention.
Figure 2:
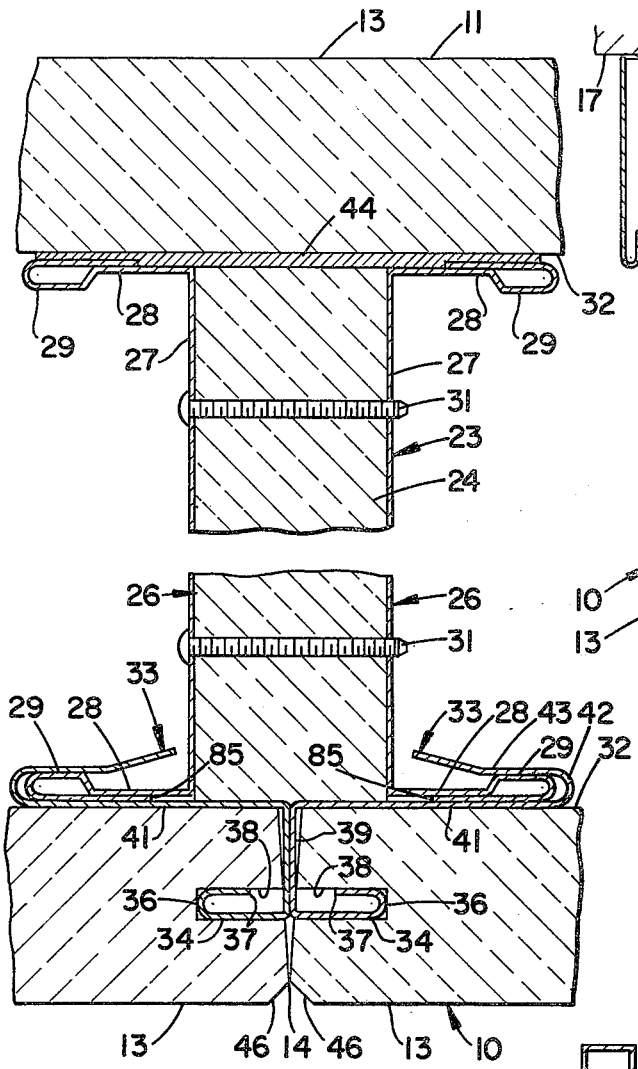
FIG. 2 is an enlarged cross section illustrating the structure of a stud and its connection to the adjacent wall panels.
Figure 4:
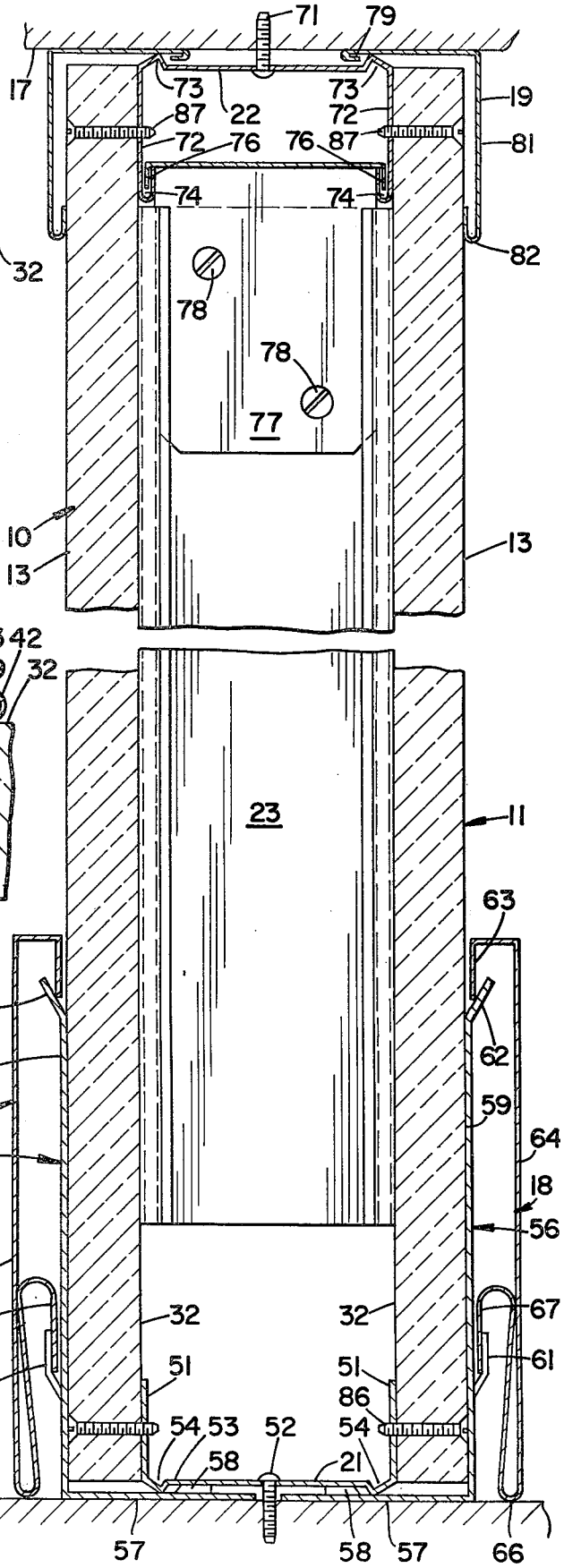
FIG. 4 is a vertical section through an assembled partition, illustrating the structure of the floor and ceiling tracks, the structue of the trim pieces, and the structure for supporting the stud at its upper end.

Referring now to FIGS. 2 through 4, each of the studs 23 has a structure, best illustrated in FIG. 2, which includes a core 24 formed of a combustion-resistant insulating material, preferably gypsum board. Secured to the opposite faces of the core 24 are a pair of similar channel-shaped or U-shaped metal members 26, each providing a base section 27 extending along the face of the core 24 and flange portions 28 provided with reverse bends at their extremities to provide a tubular stiffening bulb 29. The edges of the flanges extend back along the outside portions of the flanges in face-to-face adjacency and terminate at a location 85 spaced from the base sections 27. Suitable fasteners such as screws 31 extend through one channel member 26 through the core 24, and are threaded into the central portion of the other channel member 26. The assembled core and channel members 26 provide a generally H-shaped structure having oppositely extending flanges which extend along the inner surface 32 of the adjacent panels of the two rows 10 and 11.

In the illustrated embodiment, the panels are staggered, as best illustrated in FIG. 3, with the joints 14 in the row 10 spaced substantially midway between the joints 14 in the row 11. In such structure, a stud 23 is positioned at each of the joints so that one side of each stud is adjacent to a joint and the other side of each stud is adjacent to a midpoint in the panel on the opposite side. A pair of spline clips 33 connect the side of the stud 23 adjacent to the joint 14 to the panels forming the joint. Each of the spline clips 33 is provided with a lateral projection 34 having a reverse bend at 36 and extending back to an edge at 37. The projection 34 is proportioned to fit into a kerf 38 formed in the abutting edges of each of the panels 13 at the associated joint 14. These lateral projections are preferably sized to fit into the kerf with a relatively snug fit so that the spline clips are anchored in the edge of the associated panel 13. Further, the edges 37 are spaced back from the open end of the kerfs 38 and tend to dig in and assist in anchoring the projections in the kerfs.

Each of the spline clips 33 is also formed with an inwardly extending web 39 which extends from the lateral projection 34 to a lateral web 41, which fits along the inner face 32 of the associated panel 13 and extends adjacent to the associated flange 28 of the stud 23. At the end of the lateral web 41, each clip is formed with a reverse bend at 42 and an inwardly extending web 43 which cooperates with the web 41 to embrace the bulb 29 of the associated flange with a relatively snug fit. Consequently, each of the adjacent panels 13 is mechanically connected to the adjacent flange of the adjacent stud by a spline clip 33. The structure, however, is such that if the clips 33 are heated to a substantially greater extent than the associated flanges of the stud under a condition of a fire or the like, the clips can freely expand axially a greater amount than the flanges associated therewith so that such expansion does not tend to produce a bowing of the partition.

The opposite side of the stud 23 is preferably connected to the row along the side opposite the joint by an adhesive 44.

In the illustrated embodiment, the edges of the panels 13 are chamfered at 46 and are inclined back from the edge as they extend toward the inner wall surface so that the two panels adjacent to a joint actually abut at the joint 14 but provide spacing back from the outer surface to accommodate the spline clips 33.

Referring now to FIG. 4, the floor track 21 is generally U-shaped providing upstanding legs 51 against which the inner sides 32 of the panels 13 are positioned. Suitable screw fasteners or the like 52 secure the floor track 21 to the floor structure 16. The center portion of the base of the floor track 21 is offset at 53 away from the surface of the floor to provide a locking edge or shoulder 54 for the baseboard mounting clips 56. Such clips 56 have a horizontal portion 57 which extends inwardly of the partition along the floor surface 16 and provides a detent or projection 58 which, in cooperation with the shoulder 54 in the floor track, secures the clip in position. Each clip is also provided with an upstanding flange 59 which extends along the exterior surface of the adjacent panels 13 and provides a structure for connecting the baseboard trim member 18. Such structure includes a lanced projection 61 and an inclined edge portion 62. The baseboard trim member 18 provides an inturned edge 63 which extends down behind the inclined edge 62 of the clip 56 and an outer face portion 64 which extends down along the partition but spaced therefrom to a reverse bend at 66. From the reverse bend, the baseboard element 18 is provided with an upstanding section and a downturned edge 67 which extends behind the lance 61. Thus, the two edges of the baseboard are secured to the baseboard mounting clip by merely pressing the baseboard element downward along the panels into the clip 56.

The upper ends of the panels 13 are secured to the upper track 22, which is in turn secured to the ceiling 17 by screws 71. Here again, the upper track is formed as a generally U-shaped element having downwardly extending legs 72 against which the upper edges of the panels 13 abut. The central portion of the track 22 is offset to again provide a shoulder 73 for locking the ceiling trim 19. The lower ends of the legs 72 are formed with a reverse bend to provide upwardly facing channels 74, which in turn receive a downturned edge of a stud hanging clip 77 secured to the upper end of the stud 23 by screws 78. With this structure, the upper end of the stud is spaced down from the ceiling 17 and the lower end of the stud is spaced up from the track 21, with the stud literally hanging from the upper track 22. The ceiling trim members are L-shaped, and are provided with one leg which extends in along the ceiling and provides an in-turned end 79 which snaps past the shoulder 73 and locks the trim member in position. The trim member provides an exposed face leg 81 which extends down along the face of the partition to a reverse bend at 82, which provides a finished edge and a portion actually abutting the outer face of the adjacent panels 13.

In accordance with one preferred procedure for installing a partition incorporating the present invention, the two tracks 21 and 22 are first installed respectively on the floor 16 and ceiling 17 by means of the screws 52 and 53. Referring now to FIG. 3, a half-panel **13*a* is then positioned between an end plate 83 on which is mounted a clip 84 and against the legs 51 and 72, respectively, of the two tracks. After a spline 33 is mounted in the free edge of such panel, a first stud 23*a* is hung on the ceiling track and is moved horizontally until it fits into the installed spline clip within the kerf 38 of the panel 13*a*. A bead of suitable adhesive, such as the commercial adhesive PL-400, manufactured and sold by B. F. Goodrich Company, is applied to the opposite side of the stud 23*a* and a full panel 13*b* is then moved into position against the tracks at the top and the bottom and is pressed against the rearward side of the stud so that the adhesive 44 spreads along the interface between the inner side of the panel 13*b* and the adjacent side of the stud 23*a***.

Another spline clip is then installed in the kerf of the panel **13*b* and a second stud 23*b* is then hung on the upper track, and is moved into its installed position in which it engages the spline clip in the panel 13*b***.

A bead of adhesive is then applied to the opposite side of the stud **23*b* and a panel 13*c* with spline clips installed along opposite edges is moved into position with one spline clip assemblied with the associated flange of the stud 23***a* and the panel engaging the tracks at the upper and lower ends. The stud 23*c* is then installed in the same manner as previously described, and the next panel 13*d* is installed. This procedure of installing the panels first on one side and then on the other is continued until the partition is completed. Screws 86 are then installed to secure the lower edges of the panels to the floor track and screws 87 are installed to secure the upper edges of the panels to the ceiling track. Preferably, the screws 86 and 87 are not inserted until the various panels are installed to ensure that the panels can be positioned in proper abutting relationship along the entire partition and gaps do not occur because of irregularities in the floor.

After the screws 86 and 87 are installed, the mounting clips 56 are driven into position at spaced locations along the length of the partition. In some instances, the panels 13 will actually engage the floor, but the clips can still be driven into position because the gypsum wallboard can be deformed to accept the clips, even if a space does not exist between the floor and the panel. At locations where a space exists between the panels and the floor, due to floor irregularities, as illustrated in FIG. 4, the clips 56 merely extend past the panel and are locked by the track. The baseboard strips are then installed on the mounting clips 56 and the upper molding is pressed into position and is locked in place by the enlargement provided by the reverse bend at 79 in cooperation with the adjacent shoulder 73.

With the staggered relationship of the panels provided as illustrated in FIG. 3, full panels, which are four feet wide, can be installed with a stud spacing of about two feet. It should be recognized, however, that the present invention is not limited to the use of studs with staggered wall panels and that if joints 14 are located opposite to each other, rather than in a staggered relationship, a joint is located on each side of the adjacent studs and the spline clips 33 connect to the panels on both sides of the studs.

In the event that the partition is exposed to a fire, or the heat of a fire, the gypsum board panels tend to shrink and open up the joints 14. Referring to FIG. 2, if the joint 14 opens up, due to shrinkage of the adjacent panels 13, a condition exists in which the core 24 bridges across the joint and forms an effective seal to prevent the direct exposure of the channel members 26 of the stud to the fire heat. The fit provided by the lateral projections 34 into the associated kerfs 38 causes the spline clips to move with the associated panel so as shrinkage occurs, the two adjacent spline clips move apart with the panels. Consequently, there is no metal surface bridging the open joint exposed to the direct heat through the joint. It is recognized, however, that the spline clips will be exposed to substantial heat, and will tend to expand in an axial direction. However, since such expansion merely causes sliding between the flanges of the stud and the clip, it does not induce a bow in the stud toward the fire side of the partition. Further, a relatively long path is provided along the spline clips so excessive amounts of heat are not transmitted from the spline clips to the flanges of the stud. In fact, the spline clips are spaced from the flanges 28 of the stud until they extend to the edges 85 of the associated flange 28, and this further reduces any tendency for heat to be conducted to the flanges of the stud.

The illustrated structure, in which the bulbs 29 formed on the flange are produced by the illustrated bend arrangement and in which the inturned edges of the flange extend along the outer side of the flange, provides this increased length of path of heat flow before the spline clips engage the flange proper. The thickness of the core 24 should, of course, be selected to be sufficiently great to ensure that the core will bridge any open joints expected to be encountered. Therefore, the cores effectively bridge any open joints preventing the direct passage of heat to the metal parts of the stud and provide an effective seal to prevent water from entering the interior of the partition when the fire is extinguished. With the preferred structure, the wall can be economically produced, easily installed or removed while providing considerable resistance to the spread of fire through the partition structure.

Although the preferred embodiment of this invention has been shown and described, it should be understood that various modifications and rearrangements of parts may be resorted to without departing from the scope of the invention as disclosed and claimed herein.

What is claimed is:

1. A partition assembly comprising opposed, parallel, spaced rows of panels which abut along their adjacent edges at joints therebetween, said panels providing opposed kerfs along their abutting edges, a stud along each joint formed of a fire-resistant core of insulation material and opposed channel-shaped metal elements secured to opposite sides of said core providing a generally H-shaped stud having oppositely extending flanges adjacent the inner sides of the associated of said panels and spaced from said joint, and connecting means along at least one side of said stud projecting into said kerfs on said panels along said joint and connected to said metal elements only at locations spaced back from said joint operating to secure said panels to said stud, said panels being formed of a fire-resistant material which tends to shrink and cause opening of said joints when subjected to high temperatures, said core bridging an open joint resulting from said shrinkage to prevent direct exposure of said channel-shaped elements to heat at said open joint.

2. A partition assembly as set forth in claim 1, wherein said connecting means are connected to said stud with freedom for differential expansion.

3. A partition assembly as set forth in claim 2, wherein said connecting means are metal clips having wall portions which engage the adjacent flange of said stud on the side thereof remote from the adjacent panels.

4. A partition assembly as set forth in claim 3, wherein said metal clips provide a portion extending along said joint from the interior side of said row and provide a lateral projection which extends into a kerf with a close fit.

5. A partition assembly as set forth in claim 4, wherein said metal clips are sheet metal formed with a reverse bend to ensure said close fit, and said metal clips move with the associated panels when said panels shrink.

6. A partition assembly as set forth in claim 1, wherein said core is at least as thick as the amount said joint opens when said panels shrink.

7. A partition assembly as set forth in claim 6, wherein said core is formed of gypsum board.

8. A partition assembly comprising opposed, parallel, spaced rows of panels which abut along their adjacent edges at joints therebetween, said panels providing opposed kerfs along their abutting edges, a stud along each joint formed of a fire-resistant core of insulation material and opposed channel-shaped metal elements secured to opposite sides of said core to provide oppositely extending flanges adjacent the inner sides of the associated of said panels, and connecting means along at least one side of said stud projecting into said kerfs on said panels along said joint to secure said panels to said stud, said panels being formed of a fire-resistant material which tends to shrink and cause opening of said joints when subjected to high temperatures, said core bridging an open joint resulting from said shrinkage to prevent direct exposure of said channel-shaped elements to heat at said open joint, said connecting means being sheet metal clips having wall portions which engage the adjacent flange of said stud on the side thereof remote from the adjacent panels with freedom for differential expansion, said sheet metal clips providing a portion extending along said joint from the interior side of said row and providing a lateral projection formed with a reverse bend to ensure a close fit so that said metal clips move with an associated panel when said panels shrink, said metal clips engaging the associated flange only at locations spaced back from said joint.

9. A partition assembly as set forth in claim 8, wherein the side of said stud opposite said joint is connected to a panel in the other of said rows.

10. A partition assembly as set forth in claim 8, wherein the side of said stud opposite said joint is connected to an adjacent panel in the other of said rows at a location spaced from the edges thereof.

11. A partition assembly as set forth in claim 10, wherein said opposite side of said stud is connected to said adjacent panel by adhesive.

12. A partition assembly as set forth in claim 11, wherein said core is at least as thick as the amount said joint opens when said panels shrink.

13. A partition assembly comprising opposed, parallel, spaced rows of panels which abut along their adjacent edges at joints therebetween, said panels providing opposed kerfs along their abutting edges, a stud along each joint formed of a fire-resistant core of insulation material and opposed channel-shaped metal elements secured to opposite sides of said core to provide oppositely extending flanges adjacent the inner sides of the associated of said panels, and connecting means along at least one side of said stud projecting into said kerfs on said panels along said joint to secure said panels to said stud, said panels being formed of a fire-resistant material which tends to shrink and cause opening of said joints when subjected to high temperatures, said core bridging an open joint resulting from said shrinkage to prevent direct exposure of said channel-shaped elements to heat at said open joint, an upper track secured to said panels adjacent to the upper edge thereof, and said stud hanging from and supported by said upper track.

14. A finished demountable partition comprising a ceiling track secured to a ceiling, a floor track secured to a floor, a plurality of panels connected at their upper and lower ends to said tracks and cooperating to provide two spaced and parallel rows of panels abutting along joints therebetween, and a stud assembly positioned adjacent to each joint and connected to the panels in each row, said stud being connected to said ceiling track and being supported thereby, the lower end of said stud being spaced from said floor track and connected to said floor track solely by said panel.

15. A partition assembly comprising opposed, parallel, spaced rows of panels which abut along their adjacent edges at joints therebetween, said panels providing opposed kerfs along their abutting edges, a stud along each joint formed of a fire-resistant core of insulation material and opposed channel-shaped metal elements secured to opposite sides of said core to provide oppositely extending flanges adjacent the inner sides of the associated of said panels, and connecting means along at least one side of said stud projecting into said kerfs on said panels along said joint to secure said panels to said stud, said panels being formed of a fire-resistant material which tends to shrink and cause opening of said joints when subjected to high temperatures, said core bridging an open joint resulting from said shrinkage to prevent direct exposure of said channel-shaped elements to heat at said open joint, said connecting means being metal clips which engage an associated flange only at locations spaced back from said joint to minimize transmission of heat through said clips to said channels.

16. A partition assembly comprising opposed, parallel, spaced rows of panels which abut along their adjacent edges at joints therebetween, a stud along each joint formed of a fire-resistant core of insulation material and opposed channel-shaped metal elements secured to opposite sides of said core to provide oppositely extending flanges adjacent to the inner sides of the associated of said panels, and connecting means along at least one side of said stud secured to said panels without being exposed to the exposed surface thereof connecting said associated panels to the associated flanges, said panels being formed of fire-resistant material which tends to shrink and cause opening of said joints when subjected to high temperatures, said core bridging an open joint resulting from said shrinkage to prevent direct exposure of said channel-shaped elements to heat at said joint, said connecting means being structured to minimize transmission of heat therethrough to said channel.

17. A partition assembly as set forth in claim 16, wherein said connecting means are metal clips which provide a projection extending into the edge of the associated panels and engage an associated flange only at locations spaced back from the joint to minimize transmission of heat through said clips to said channels.

* * * * *